US006796933B2

(12) United States Patent
Bois

(10) Patent No.: US 6,796,933 B2
(45) Date of Patent: Sep. 28, 2004

(54) STACK OF BAGS HAVING CURSORS INITIALED POSITIONED OFFSET FROM EACH OTHER

(75) Inventor: Henri Georges Bois, Neuilly-sur-Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/941,585

(22) Filed: Aug. 30, 2001

(65) Prior Publication Data

US 2002/0052279 A1 May 2, 2002

Related U.S. Application Data

(63) Continuation of application No. 09/463,411, filed as application No. PCT/FR99/01281 on Jun. 1, 1999, now Pat. No. 6,334,709.

(30) Foreign Application Priority Data

Jun. 3, 1998 (FR) ..... 98 06956

(51) Int. Cl.[7] ..... B31B 1/90

(52) U.S. Cl. ..... 493/394; 493/213; 493/927

(58) Field of Search ..... 493/394, 194, 493/213, 927; 53/469, 384.1; 383/9, 67

*Primary Examiner*—Eugene Kim
*Assistant Examiner*—Sameh H. Tawfik
(74) *Attorney, Agent, or Firm*—Jacobson Holman PLLC

(57) ABSTRACT

A set of at least three consecutive bags in a succession, each bag having two closure strips and a cursor situated at a respective distance from one end of the strips, the strips and the cursor being identical between the bags. Between the bags in each pair of adjacent bags, the distances are different.

2 Claims, 2 Drawing Sheets

STACK OF BAGS HAVING CURSORS INITIALED POSITIONED OFFSET FROM EACH OTHER

This is a continuation of application Ser. No. 09/463,411 filed Mar. 22, 2000, now U.S. Pat. No. 6,334,709, which in turn is a continuing application of the national phase under 35 USC, §371 of PCT International Application No. PCT/FR99/01281 which has an International Filing Date of Jun. 1, 1999, which designated the United States a of America and was published in English and claims priority from 98/06956 filed Jun. 3, 1998, in France which is claimed herein

FIELD OF THE INVENTION

The invention relates to bags that are reclosable by means of closure strips, and to the manufacture thereof.

BACKGROUND OF THE INVENTION

Methods are known for manufacturing bags out of plastic material in which each bag opening has two closure strips and a cursor that slides thereon. During manufacture, the cursor is situated at a predetermined distance from the ends of the strips so as to avoid interfering with the heat-sealing and cutting operations that are performed. However, when the bags are placed one on top of another, the cursors pile up against one another, thereby generating a stack whose height is much greater at the cursors than over the remainder of the bags. Thus, storage of the bags is complicated by the volume of such stacks and by their instability. In particular, it is difficult to make up rolls or stacks having a large number of bags.

U.S. Pat. No. 5,682,730 discloses a stack of bags having a lower series of successive bags in which said distance has a first constant value such that the cursors are stacked one on top of another close to one end of the strips, and an upper series of successive bags in which said distance has a second constant value, different from the first value, with the cursors of said second series being stacked one on top of another at the other end of the strips. In this way, the two stacks of cursors do not interfere with each other and both of them occupy almost the same height, thereby greatly reducing the total height of the stack. That disposition is made possible because the bags are flexible. Nevertheless, the height of the stack of bags remains relatively large.

SUMMARY OF THE INVENTION

An object of the invention is to improve storage of bags, in particular for the purpose of making rolls or stacks of a very large numbers of bags.

According to the invention, this object is achieved by a set of at least three consecutive bags in succession, each bag having two closure strips and a cursor situated at a respective distance from one end of the strips, the strips and the cursor being identical for each of the bags, and in which, between the bags in each pair of adjacent bags, the distances are different.

Thus, a disposition of the cursors is obtained which differs from the above-mentioned known disposition and which makes it possible to store the bags in a volume that is different and more stable, and, for example, in a stack that is of smaller height. For example, the cursors can be relatively offset by half the length of a cursor. Under such circumstances, stacking the bags causes the strips to be twisted slightly, and causes the cursors that lie one on another to be inclined. This reduces the volume of the stack at the cursors.

Preferably, the distances differ by not less than the size of the cursors parallel to the strips.

In this way, the bags can be stacked one on top of another with the strips being contiguous but without the stacked cursors interfering with one another, the cursors being disposed next to one another. Under such circumstances, the volume of the set of bags corresponds substantially to that generated by the walls and the strips, and is therefore considerably reduced. As a result, the stack of bags is stable.

Advantageously, the distances on adjacent bags vary in a constant progression.

It is thus possible to stack a very large number of bags while optimizing the volume available for the cursors without risking interference, even between cursors of bags that are not consecutive.

Advantageously, the distances vary by an increment that is constant.

Advantageously, the bags are disposed so that their strips are contiguous.

Advantageously, the set constitutes a roll of bags.

Advantageously, the set constitutes a stack of bags.

The invention also provides a method of manufacturing at least three bags each having two closure strips and a cursor, the strips and the cursors being identical between the bags, in which each cursor is disposed at a respective distance from one end of the strips, and in which the cursors are disposed in such a manner that the distances are different between any two successive bags.

The invention also provides a manufacturing system for manufacturing Bags each including two closure strips and a cursor, the installation comprising means for placing each cursor at a respective distance from one end of the strips, in which the means are organized to place the cursors of any two successive bags at distances that are different.

BRIEF DESCRIPTION OF THE DRAWINGS

Other characteristics and advantages of the invention will appear further on reading the following description of a preferred embodiment given by way of non-limiting example. In the accompanying drawings.

DETAILED DESCRIPTION OF THE PREFERRED EMBODIMENTS

Figure 1:
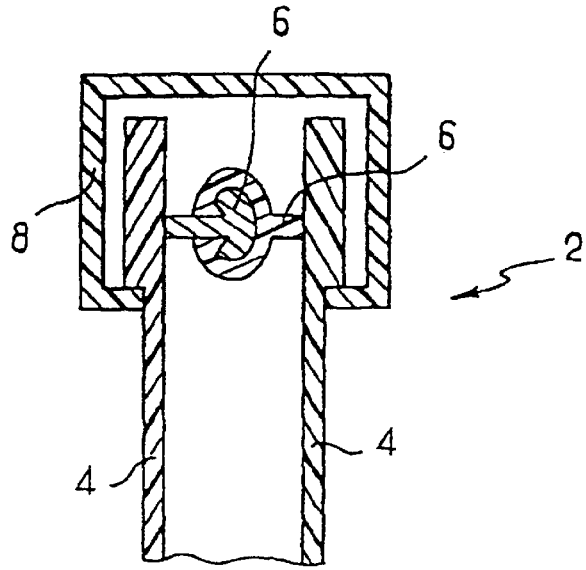
FIG. 1 is a fragmentary view of a bag in cross-section through its closure strips.
Figure 2:
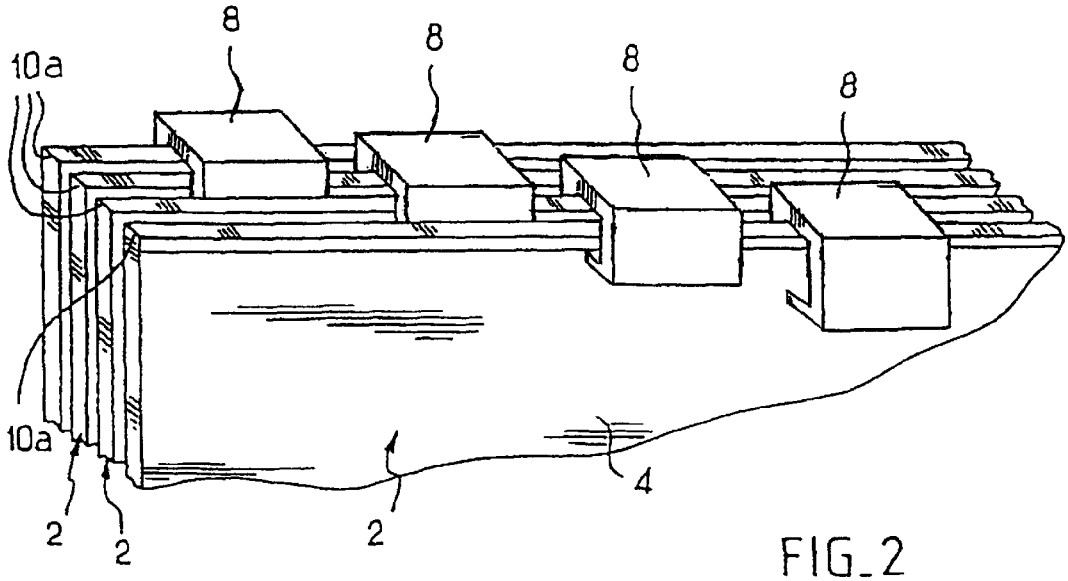
FIG. 2 is a perspective view showing how the cursors of a plurality of bags in a set are positioned.

With reference to FIG. 1, the invention applies to identical bags 2 of a type that is known. The bag 2 of plastic material has two rectangular plane walls 4 placed side by side and bonded together via three of their edges so as to constitute a bag. The unbonded sides form an opening and receive complementary rectilinear closure strips 6 on their inside faces to constitute a releasable leakproof closure. A cursor 8 is slidably mounted on the strips 6 and is shaped fin a manner that is not shown but that is known so that sliding of the cursor in one direction causes the strips 6 to be associated with each other so as to close the bag 2, while sliding in the opposite direction separates the strips so as to open the bag.

Figure 5:
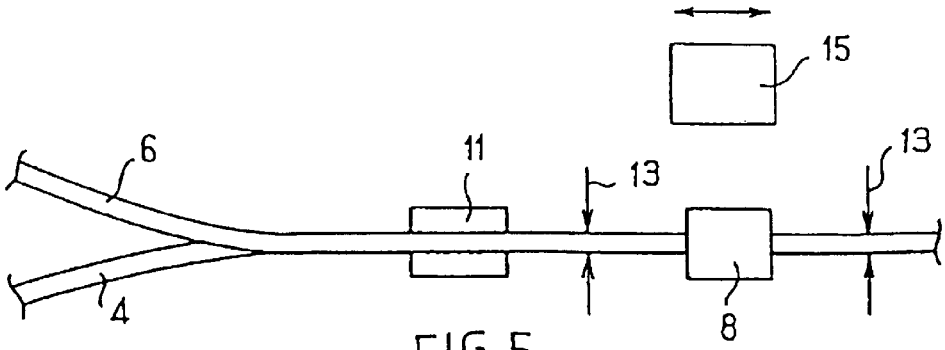
FIG. 5 is a diagrammatic view of a manufacturing system of the invention.

With reference to FIG. 5, in the method of the invention for manufacturing bags, the bags 2 are formed from a contiguous membrane 4 and the strips 6 are applied and bonded to the bags continuously at a station 11, before or after the membrane is cut up into individual bags. When the strips 6 are put into place, they can already carry one cursor 8 for each bag, or else the cursors 8 can be fitted after the strips 6 have been placed on the bags. Manufacture includes a step of heat-sealing the ends 10*a*, 10*b* of the strips 6 to each other and of cutting the strips in a station 13, which operation may take place simultaneously with the step of cutting the bags apart from one another.

Figure 3:
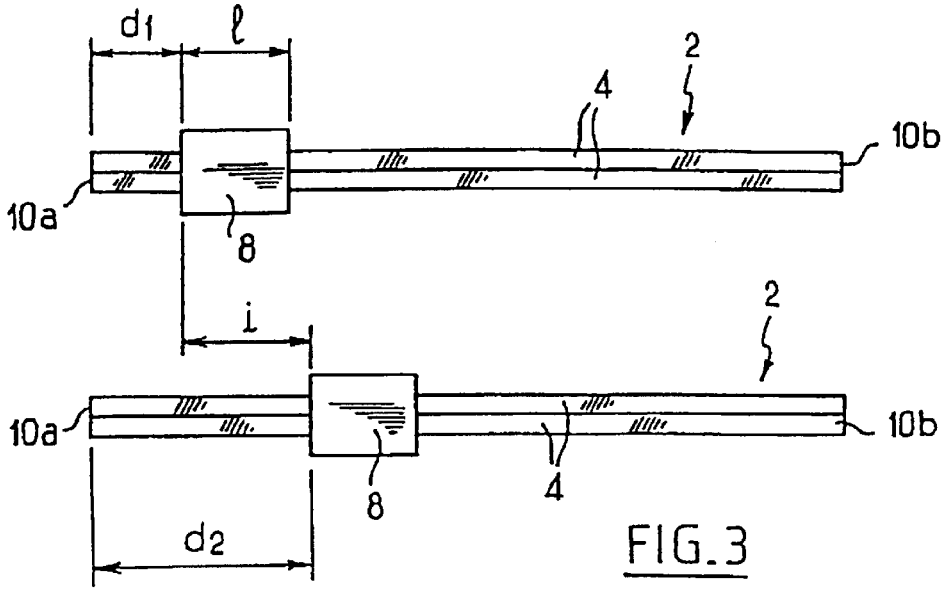
FIG. 3 is an end view of two bags on from FIG. 2.
Figure 4:
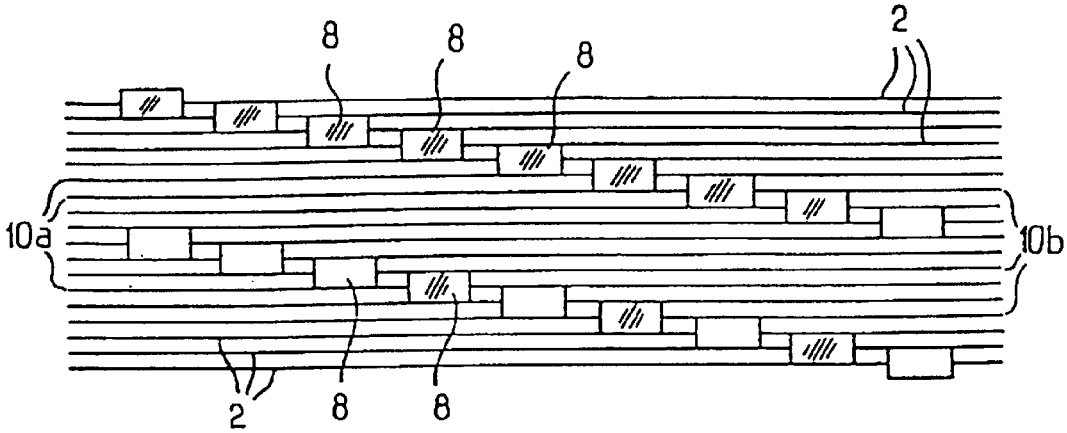
FIG. 4 is an end view of a stack comprising a large number of bags.

At some stage during manufacture, after the cursor 8 has been put into place, e.g. while the strips 6 are being cut, a positioning device 15 is programmed to slide the cursor 8 of each bag along the strips and to place it at a predetermined distance $d_1$, $d_2$ from one of the ends 10*a* of the strips. This distance $d_1$, $d_2$ is designed so as to be different for any two successive bags 2 during manufacture. Specifically, and with reference to FIG. 3, the difference between $d_1$ and $d_2$ is an increment $\underline{i}$ greater than the length $\underline{1}$ of the cursor 8 parallel to the strips 6. In addition, for a given series of bags 2, e.g. a series of nine bags as shown in FIG. 4, the distance d is caused to vary monotonically, i.e. it decreases only or it increases only (as in this case) on going from one bag to the next in the series. The increment $\underline{i}$ between bags 2 is constant in this case. Care is preferably taken to ensure that the value of the increment $\underline{i}$ is only slightly greater than the length $\underline{1}$ of a cursor 8, and in particular is less than $2\times\underline{1}$, e.g. being equal to $1.5\times\underline{1}$ so as to ensure that the largest possible number of bags can be included in the same series before reaching the other end 10*b* of the strips.

At the end of such manufacture, bags 2 are obtained whose cursors 8 are at respective different above-specified distances $d_1$, $d_2$. The bags 2 can thus be rolled up and stacked by causing the respective ends 10*a* and 10*b* of the strips 6 to coincide without giving rise to mutual interference between the cursors 8 within a given series of bags, or indeed between successive series of bags, such as the two series of nine bags each shown in FIG. 4.

What is claimed is:

1. A method of manufacturing at least three bags, each of the bags having two closure strips and a cursor slidably mounted on said two closure strips, the closure strips and the cursor being identical between the bags, said method comprising:

sliding each cursor along uppermost edges of the closure strips at a respective distance from one end of the closure strips with the cursor of one bag contacting the uppermost edge of at least one of the two closure strips of an adjacent bag, and slidingly positioning the cursors with the distances being different between every two adjacent and successive bags of said at least three bags and with the cursor in a middle bag of every three consecutive bags contacting one of the closure strips of both bags on opposite sides of the middle bag.

2. A system for manufacturing bags, each of the bags including two closure strips and a cursor slidably mounted on said two closure strips, the system comprising a positioning device sliding each cursor along uppermost edges of the closure strips at a respective distance from one end of the closure strips, the positioning device slides the cursors of every two adjacent and successive bags of at least three successive bags to distances that are different with the cursor of one bag contacting the uppermost edge of at least one of the two closure strips of an adjacent bag and with the cursor in a middle bag of every three consecutive bags contacting one of the closure strips of both bags on opposite sides of the middle bag.

* * * * *